US008534808B2

(12) United States Patent
Aruga et al.

(10) Patent No.: US 8,534,808 B2
(45) Date of Patent: Sep. 17, 2013

(54) LIQUID EJECTING APPARATUS AND CLEANING METHOD IN LIQUID EJECTING APPARATUS

(75) Inventors: Tomohiro Aruga, Matsumoto (JP); Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 245 days.

(21) Appl. No.: 13/022,601

(22) Filed: Feb. 7, 2011

(65) Prior Publication Data

US 2011/0193900 A1 Aug. 11, 2011

(30) Foreign Application Priority Data

Feb. 8, 2010 (JP) ..... 2010-025280
Feb. 8, 2010 (JP) ..... 2010-025281

(51) Int. Cl.
*B41J 2/175* (2006.01)

(52) U.S. Cl.
USPC ..... 347/85

(58) Field of Classification Search
CPC ..... B41J 2/175; B41J 2/17596
USPC ..... 347/6, 30, 33, 84–87
See application file for complete search history.

(56) References Cited

U.S. PATENT DOCUMENTS

2007/0126816 A1 6/2007 Nishida
2008/0143779 A1* 6/2008 Yoshida ..... 347/30
2009/0147053 A1 6/2009 Yokouchi

FOREIGN PATENT DOCUMENTS

JP 2007-152725 A 6/2007
JP 2009-178867 A 8/2009

* cited by examiner

*Primary Examiner* — An Do
(74) *Attorney, Agent, or Firm* — Kilpatrick Townsend & Stockton LLP

(57) ABSTRACT

The liquid ejecting apparatus includes nozzles which eject ink, an ink flow path which supplies ink from the upstream side toward the downstream side, a maintenance pump capable of suctioning and discharging ink from the ink flow path, a one-way valve which is opened in accordance with decompression on the downstream side, thereby allowing passage of ink from the upstream side to the downstream side, and a control unit which controls the driving of the maintenance pump, thereby performing a cleaning process, wherein the control unit makes the maintenance pump suction ink from a pressure-changing position in the ink flow path by performing the suction driving of the maintenance pump after making the maintenance pump discharge ink from the pressure-changing position in the ink flow path into the ink flow path by performing the discharge driving of the maintenance pump.

17 Claims, 12 Drawing Sheets

LIQUID EJECTING APPARATUS AND CLEANING METHOD IN LIQUID EJECTING APPARATUS

BACKGROUND

1. Technical Field

The present invention relates to a liquid ejecting apparatus such as an ink jet type printer, for example, and a cleaning method in a liquid ejecting apparatus.

2. Related Art

Heretofore, as a liquid ejecting apparatus which ejects liquid onto a target, an ink jet type printer has become widely known. The printer is made so as to carry out printing (image formation) on the target by ejecting ink (liquid), which is supplied to a recording head (a liquid ejecting head), from nozzles formed in the recording head.

In such a printer, if the mixing-in of air bubbles, the rising of a meniscus, the thickening of ink, or the like occurs, satisfactory ejection of ink cannot be attained, thereby causing the lowering of printing quality. For this reason, in such a printer, for example, as described in JP-A-2007-152725, cleaning (pressurization cleaning) is performed by pressuring and supplying ink from the upstream side which is an ink cartridge side containing ink to the downstream side which is the recording head side, thereby discharging ink from the nozzle.

In such a printer, back pressure is applied to ink, thereby making a meniscus of ink be located in the vicinity of a nozzle orifice. As a configuration of applying back pressure to ink, in general, a one-way valve is used which allows passage of ink from the upstream side to the downstream side in a case where the downstream side has been decompressed. The one-way valve has a pressure chamber, in which a volume changes in accordance with a change in pressure on the downstream side, and if the downstream side is decompressed, the pressure chamber contracts, thereby opening the valve, whereas a valve closed state is maintained even if ink is pressurized and supplied from the upstream side.

For this reason, like the printer of JP-A-2007-152725, in the case of pressurizing and supplying ink from the cartridge side, thereby supplying it to the nozzle side, ink remains pressurized further in the downstream side than the one-way valve.

Further, in such a printer, ink mist which is generated accompanying the ejection of ink, or ink overflowed from the nozzle adheres to a nozzle formation face of the recording head, in which the nozzles are formed, whereby the nozzle formation face is contaminated. Accordingly, for example, as described in JP-A-2009-178867, wiping which sweeps the nozzle formation face by using a wiper is performed, thereby removing foreign materials adhered to the nozzle formation face.

Incidentally, ink supplied to the recording head forms a meniscus in the vicinity of the nozzle orifice and is ejected from the nozzle in accordance with the driving of a piezoelectric element. For this reason, if the wiper comes into contact with the nozzle formation face, there is a possibility that ink may flow out down the wiper. Accordingly, in the printer of JP-A-2009-178867, the contact between the wiper and ink is suppressed by performing wiping in a state where the meniscus is drawn into the nozzle by driving the piezoelectric element.

Incidentally, in a case where ink is pressurized further at the downstream side than the one-way valve, since a pressurizing force is also transmitted to the one-way valve, the pressure chamber expands, thereby accumulating the pressurizing force. For this reason, like the printer of JP-A-2007-152725, in a case where cleaning is performed by pressurizing ink further at the downstream side than the one-way valve, the back pressure of ink cannot be adjusted by the one-way valve, and further, the pressurizing force accumulated in the pressure chamber is transmitted to the nozzle side. Even after the end of cleaning, there is a fear that ink overflows from the nozzle, such that a lot of ink is wasted with the cleaning.

Further, in the printer described in JP-A-2009-178867, the meniscus of ink is made to be located in the vicinity of the nozzle orifice by a capillary force. Since ink is forced to the nozzle orifice side by the capillary force of the nozzle, in the case of raising the meniscus by driving the piezoelectric element, it is difficult to maintain the risen position.

Accordingly, as the manner of providing a suction force larger than the capillary force of the nozzle, the manner of suctioning ink by using a pump can be considered. However, in the case of providing a pump at a single flow path (liquid supply flow path) which communicates with a plurality of nozzles and suctions ink, thereby raising the meniscus, the more the distance from the pump to the nozzle is distant, the more difficult it is for the suction force of the pump to reach the nozzle. For this reason, the more the distance from the pump to the nozzle is distant, the more easily the position of the meniscus is lowered, so that variation occurs in position of the meniscus for each nozzle.

Therefore, if ink is supplied to the nozzle side after the end of wiping, in the nozzle in which the meniscus is maintained at the risen position, the meniscus moves to the vicinity of the nozzle orifice. On the other hand, in the nozzle in which the meniscus has descended, there is a possibility that ink may overflow from the nozzle.

SUMMARY

An advantage of some aspects of the invention is that it provides a liquid ejecting apparatus in which it is possible to perform wiping where outflow of liquid from a nozzle is suppressed, a liquid ejecting apparatus in which it is possible to perform cleaning where consumption of liquid after the end of the cleaning is suppressed, and a cleaning method in a liquid ejecting apparatus.

According to a first aspect of the invention, there is provided a liquid ejecting apparatus including: nozzles which eject liquid; a liquid supply flow path which supplies the liquid from a liquid supply source to the nozzles; a pump which suctions the liquid in the liquid supply flow path from a first position in the liquid supply flow path and discharges the liquid from the first position into the liquid supply flow path; a one-way valve which is provided at a second position which is further on the upstream side than the first position in the liquid supply flow path, and is opened in a case where a pressure chamber, in which a volume changes in accordance with a change in pressure on the downstream side, contracts in accordance with decompression on the downstream side, thereby allowing passage of the liquid from the liquid supply source side to the nozzle side; and a control unit which controls the driving of the pump so as to make the pump suction the liquid in the liquid supply flow path from the first position after making the pump discharge the liquid from the first position into the liquid supply flow path.

According to this configuration, by performing the discharge driving of the pump, it is possible to perform a cleaning process in which liquid is supplied to the nozzle side through the liquid supply flow path and then discharged from the nozzle. At this time, since the pump discharges liquid into the liquid flow path at the first position, discharge pressure also acts on the pressure chamber of the one-way valve provided at the second position. Then, in the one-way valve, the pressure chamber expands with a valve closing state maintained, and thereby accumulates a pressurizing force. However, since the pump performs suction driving after the discharge driving is performed, transmission of the pressurizing force to the nozzle side can be suppressed by suctioning liquid in the liquid supply flow path, thereby contracting the pressure chamber. Therefore, it is possible to perform cleaning where consumption of liquid after the end of the cleaning is suppressed.

In the liquid ejecting apparatus according to the above aspect of the invention, the pump may include a volume-variable liquid chamber which communicates with the inside of the liquid supply flow path, a volume-variable gas chamber which contains gas, and a volume changing section which changes the volumes of the liquid chamber and the gas chamber, and the control unit may control the volume changing section to make the pressure of the gas compressed by reducing the volume of the gas chamber act on the liquid in the liquid chamber, thereby making the pump perform discharge driving.

In a case where the viscosity of liquid has increased or a case where air bubbles have been mixed in liquid, the fluidity of the liquid decreases. In that respect, according to this configuration, by compressing gas in the gas chamber and also providing the pressure of the compressed gas to liquid in the liquid chamber, it is possible to vigorously discharge liquid into the liquid supply flow path. Since it is not necessary to provide a configuration of accumulating the pressurizing force of the pump, such as a valve, at the liquid supply flow path, an increase in the number of parts is suppressed, whereby it is possible to speed up the flow velocity of liquid.

In the liquid ejecting apparatus according to the above aspect of the invention, an amount of liquid that the pump can suction in accordance with the suction driving may be larger than an amount of change in the volume of the pressure chamber.

According to this configuration, since the pressure chamber expanded in accordance with the discharge driving of the pump can be contracted by the suction driving of the pump so as to become a minimal volume, transmission of the pressurizing force to the nozzle side can be suppressed. In a case where the pump has suctioned liquid equal to or greater than an amount of change in the pressure chamber, since the inside of the pressure chamber is decompressed, the one-way valve is opened, so that liquid is supplied from the upstream side into the pressure chamber. For this reason, it is possible to suppress consumption of liquid after cleaning and also adjust pressure further on the downstream side than the one-way valve in the liquid supply flow path.

According to a second aspect of the invention, there is provided a cleaning method in a liquid ejecting apparatus which includes nozzles which eject liquid, and a liquid supply flow path which supplies the liquid from a liquid supply source to the nozzles, the method including: suctioning the liquid in the liquid supply flow path from a first position in the liquid supply flow path; and discharging the liquid suctioned in the suctioning from the first position in the liquid supply flow path into the liquid supply flow path.

According to this configuration, the same working effects as those of the invention related to the liquid ejecting apparatus according to the first aspect can be obtained.

In the cleaning method in a liquid ejection apparatus according to the second aspect of the invention, the method may further include opening a one-way valve, after the suctioning, which is provided at a second position further on the upstream side than the first position in the liquid supply flow path and is opened in a case where a pressure chamber, in which a volume changes in accordance with a change in pressure on the downstream side, contracts in accordance with decompression on the downstream side, thereby allowing passage of the liquid from the liquid supply source side to the nozzle side.

In the cleaning method in a liquid ejection apparatus according to the second aspect of the invention, the method may further include closing the one-way valve after the liquid is discharged into the liquid supply flow path in the discharging.

In the cleaning method in a liquid ejection apparatus according to the second aspect of the invention, the method may further include suctioning the liquid in the liquid supply flow path from the first position in the liquid supply flow path after the liquid is discharged into the liquid supply flow path in the discharging.

According to a third aspect of the invention, there is provided a liquid ejecting apparatus including: a plurality of nozzles which ejects liquid; a liquid supply chamber which communicates with each of the plurality of nozzles, thereby supplying the liquid to each of the nozzles; a liquid supply flow path which supplies the liquid from a liquid supply source to the liquid supply chamber and is connected at a plurality of branched flow paths thereof to the liquid supply chamber; a pump which suctions the liquid in the liquid supply flow path and discharges the liquid into the liquid supply flow path; a wiping section which brings a wiper into contact with a nozzle formation face of a liquid ejecting head, in which the nozzles are formed, thereby sweeping the nozzle formation face; and a control unit which makes the wiping section sweep the nozzle formation face after the liquid is suctioned from the liquid supply flow path by making the pump perform suction driving, and thereafter, makes the pump perform discharge driving, thereby discharging the liquid to the liquid supply flow path.

For example, in the case of suctioning liquid by a single liquid supply flow path which is not branched, a difference in suction power which is transmitted to the respective nozzles become larger, so that variation occurs in the positions of the meniscuses M. In that respect, according to this configuration, since the liquid supply flow path is branched and connected to the liquid supply chamber, suction power can be transmitted to plural locations in the liquid supply chamber. Since the nozzle formation face can be swept by the wiping section in a state where the meniscus has risen in each nozzle, consumption of liquid accompanying the contact of the wiper with liquid can be suppressed. Since the meniscus rises in a state where variation in position has been reduced, it is possible to suppress the overflowing of liquid from the nozzle at the time of the discharge driving of the pump. Therefore, it is possible to perform wiping where outflow of liquid from the nozzle is suppressed.

In the liquid ejecting apparatus according to the third aspect of the invention, in the liquid supply chamber, at least one connection port, to which the downstream end of the liquid supply flow path is connected, may be formed for each of a plurality of areas sectioned along a longitudinal direction of the liquid supply chamber.

According to this configuration, since at least one connection port is formed for each of a plurality of areas in the liquid supply chamber, a possibility that the downstream ends of the liquid supply flow path may be disproportionately connected to the liquid supply chamber is reduced. Therefore, the bias of suction power which is exerted to the inside of the liquid supply chamber when the pump performs the suction driving is suppressed, so that variation in the positions of the meniscuses can be further reduced.

In the liquid ejecting apparatus according to the third aspect of the invention, in the liquid supply flow path, a connection position where the pump is connected may be further on the upstream side than a branching portion where the liquid supply flow path is branched.

According to this configuration, it is possible to transmit pressure to the liquid supply chamber through the branched liquid supply flow path by driving a single pump. Therefore, compared to a case where the pump is provided at each flow path which is further on the downstream side than the branching portion, the number of parts is reduced, so that a reduction in size of the liquid ejecting apparatus can be attained.

The liquid ejecting apparatus according to the third aspect of the invention may further include a flow path valve which is provided at a position which is further on the upstream side than a connection position of the pump in the liquid supply flow path, so as to be able to open and close the inside of the liquid supply flow path, wherein the control unit carries out suction driving of the pump in a state where the flow path valve has been closed.

According to this configuration, the pump performs the suction driving in a state where the flow path valve has been closed, whereby it is possible to suppress the inflow of liquid from the upstream side and suction liquid from the downstream side. Therefore, the amount of liquid which is supplied to the downstream side when the pump performs the discharge driving becomes approximately equal to the amount of liquid suctioned in accordance with the suction driving. For this reason, it is possible to reduce a possibility that liquid may overflow from the nozzle, and also to reduce a possibility that the nozzle formation face after wiping may be contaminated with liquid overflowed from the nozzle.

According to a fourth aspect of the invention, there is provided a wiping method in a liquid ejection apparatus which includes a plurality of nozzles which ejects liquid, a liquid supply chamber which communicates with each of the plurality of nozzles, and a liquid supply flow path which can supply the liquid from the upstream side which is a liquid supply source side to the downstream side which is the liquid supply chamber side and is connected at branched downstream ends thereof to the liquid supply chamber, the method including: suctioning the liquid in the liquid supply flow path by performing suction driving of a pump capable of suctioning the liquid in the liquid supply flow path and also capable of discharging the liquid into the liquid supply flow path; wiping a nozzle formation face of a liquid ejection head, in which the nozzles are formed, by bringing a wiper into contact with the nozzle formation face in a state where the liquid has been suctioned in the suctioning; and discharging the liquid suctioned in the suctioning into the liquid supply flow path by performing discharge driving of the pump.

According to this configuration, the same working effects as those of the invention related to the liquid ejecting apparatus according to the third aspect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments that embody a liquid ejecting apparatus according to the invention in an ink jet type printer will be described on the basis of the drawings. A "right-and-left direction" and an "up-and-down direction", as mentioned in the following explanation, are respectively set to represent a right-and-left direction and an up-and-down direction, that are indicated by arrows in FIG. 1. A "front-and-back direction", as mentioned herein, is set to represent a direction perpendicular to the plane of paper of FIG. 1.

Figure 1:
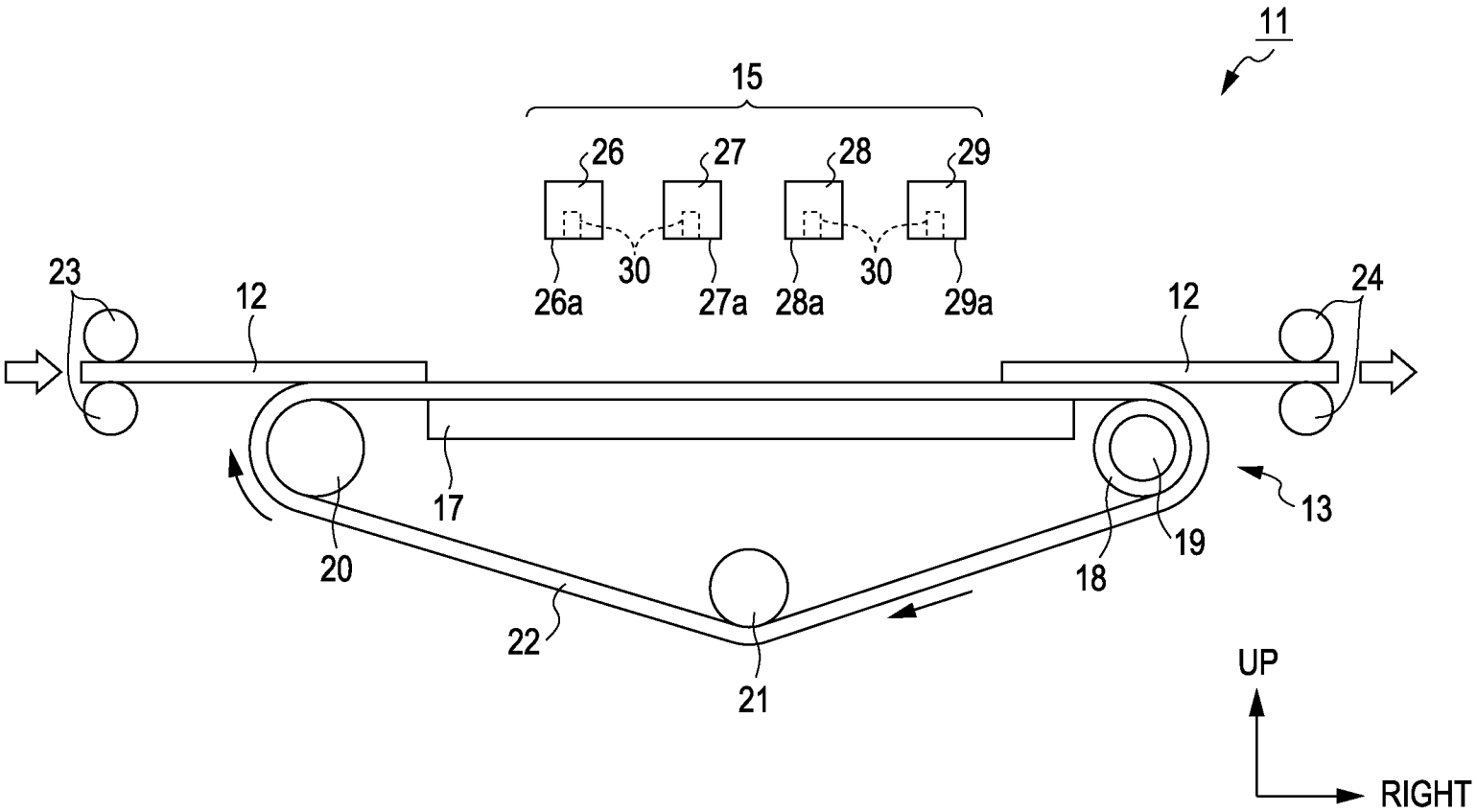
FIG. 1 is a schematic diagram of a printer of an embodiment.

As shown in FIG. 1, an ink jet type printer (hereinafter also referred to as a "printer") 11 as the liquid ejecting apparatus includes a transport unit 13 for transporting paper 12 as a target and a recording head unit 15 for carrying out printing on the paper 12.

The transport unit 13 includes a rectangular plate-like platen 17 which is long in the right-and-left direction. While a driving roller 18 extending the front-and-back direction is disposed at the right side of the platen 17 so as to be able to be rotationally driven by a driving motor 19, a driven roller 20 extending the front-and-back direction is rotatably disposed at the left side of the platen 17. Further, a tension roller 21 extending the front-and-back direction is rotatably disposed below the platen 17.

An endless transport belt 22 having a plurality of through-holes is wound around the driving roller 18, the driven roller 20, and the tension roller 21 so as to surround the platen 17. In this case, the tension roller 21 is biased downward by a spring member (not shown) and provides tension to the transport belt 22, thereby suppressing slack of the transport belt 22.

By rotationally driving the driving roller 18 in the clockwise direction as viewed from the front side, the transport belt 22 is moved to circle outside the driving roller 18, the tension roller 21, and the driven roller 20 in the clockwise direction as viewed from the front side. The paper 12 is suctioned to the platen 17 side across the transport belt 22 by a suction section (not shown) in a case where the paper 12 is located at a position facing the upper face of the platen 17, and is transported from the left side that is the upstream side toward the right side that is the downstream side.

A pair of upper and lower paper feed rollers 23 for sequentially feeding one by one a plurality of unprinted paper 12 onto the transport belt 22 is provided at the diagonally left upper side of the driven roller 20. On the other hand, a pair of upper and lower paper discharge rollers 24 for discharging one by one the printed paper 12 from above the transport belt 22 is provided at the diagonally right upper side of the driving roller 18.

Figure 2:
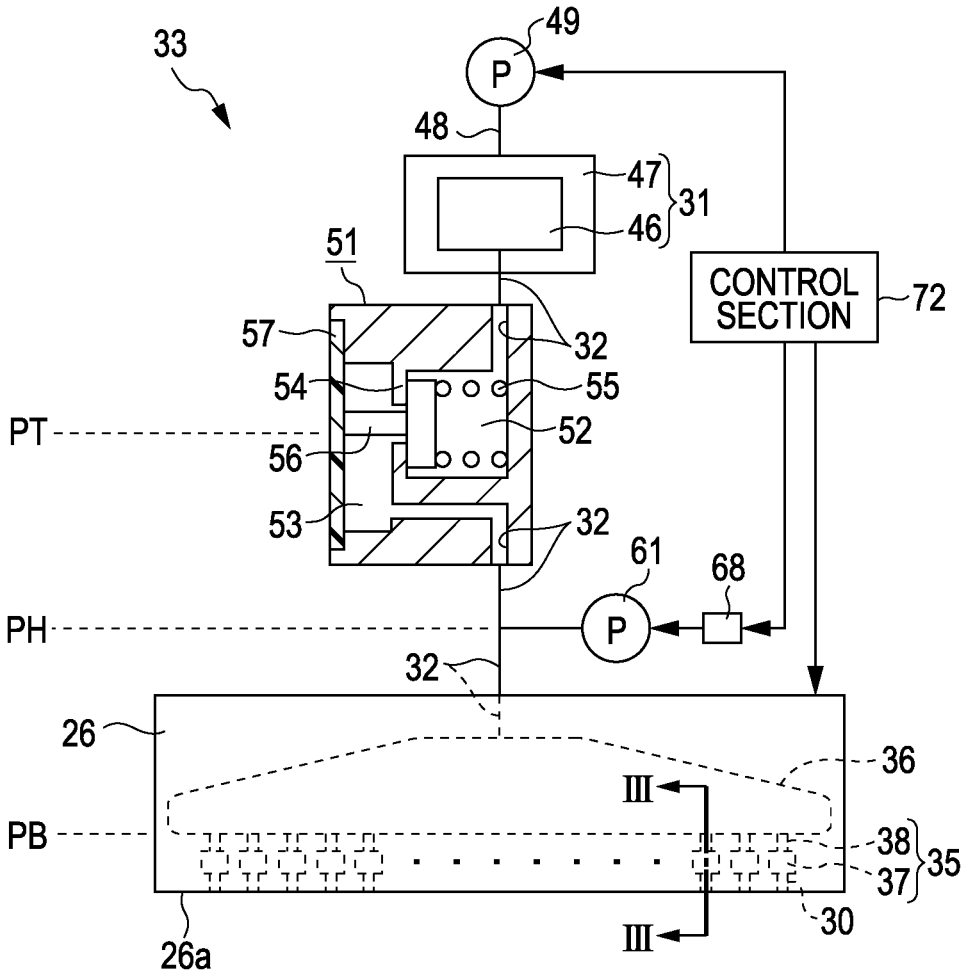
FIG. 2 is a schematic diagram of an ink supply system of a first embodiment.

As shown in FIGS. 1 and 2, at the recording head unit 15, recording heads 26 to 29 as a plurality of pieces (in this embodiment, four pieces) of liquid ejecting heads each extending in the front-and-back direction are provided at intervals in the right-and-left direction. In nozzle formation faces 26*a* to 29*a*, each of which becomes the lower face of each of the recording heads 26 to 29, a number of nozzles 30 are regularly opened at given intervals in the front-and-back direction so as to form rows of nozzles along the front-and-back direction. To each nozzle 30 constituted in this manner, the same type of ink (liquid) is supplied for each of the recording heads 26 to 29 and then ejected from the nozzle 30.

As shown in FIG. 2, an ink supply device 33 which supplies black ink from an ink cartridge 31 as a liquid supply source, in which the black ink is contained, through an ink flow path 32 as a liquid supply flow path is connected to the first recording head 26. Similarly, the ink supply device 33 which supplies ink from each of the ink cartridges 31, in which ink of the respective colors of cyan, magenta, and yellow is contained, is connected to each of the second to fourth recording heads 27 to 29.

However, since the configurations of the respective ink supply devices 33, each of which supplies ink from each ink cartridge 31 to each of the recording heads 26 to 29, are the same as each other, in FIG. 2, only one ink supply device 33 which supplies ink to the first recording head 26 is shown along with the first recording head 26 and the ink cartridge 31. In the following description, the first recording head 26 and the ink supply device 33 supplying ink to the first recording head 26, which are shown in FIG. 2, are explained as an example.

Figure 3:
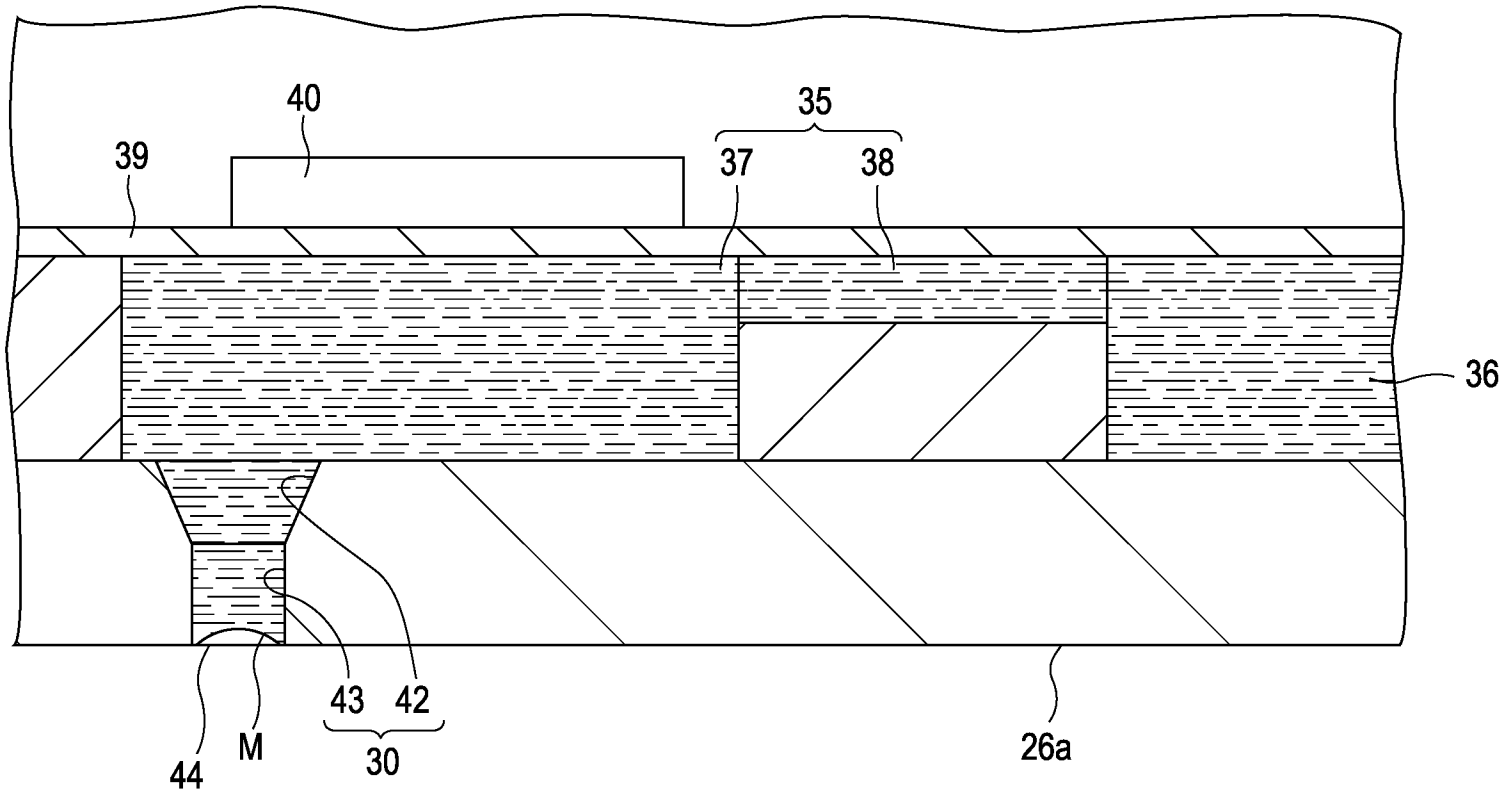
FIG. 3 is a sectional schematic diagram as viewed in the direction of the arrow III-III of FIG. 2.

As shown in FIGS. 2 and 3, in the first recording head 26, a reservoir 36 which communicates with the downstream side of the ink flow path 32 is formed so as to extend in the front-and-back direction along the row of nozzles and also a plurality of branched flow paths 35 individually corresponding to the respective nozzles 30 from plural positions in the extending direction of the reservoir 36 is formed in a divergent fashion. Downstream end positions in the reservoir 36, which become the branching points of the branched flow paths 35, are set to be a branching position PB.

Each branched flow path 35 is constituted by a cavity 37 which communicates with the nozzle 30, and a communicating flow path 38 which communicates with the cavity 37 and the reservoir 36. In a direction (a direction perpendicular to the plane of paper in FIG. 3) perpendicular to a direction in which ink flows, a cross-section area of the communicating flow path 38 is set to be small compared to a cross-section area of a flow path of the cavity 37.

Further, as shown in FIG. 3, at a position adjacent to the cavity 37, a piezoelectric element 40 is disposed through a vibration plate 39 which forms one wall face of the cavity 37. By vibrating the vibration plate 39 by contracting and extending the piezoelectric element 40, the volume of the cavity 37 is changed, whereby ink is ejected from the nozzle 30. If ink in the cavity 37 is reduced in accordance with ejection, ink is supplied from the ink cartridge 31 side through the communicating flow path 38, the reservoir 36, and the ink flow path 32. Therefore, the branched flow path 35, the reservoir 36, and the ink flow path 32 serve as a liquid supply flow path capable of supplying ink from the upstream side which is the ink cartridge 31 side to the downstream side which is the nozzle 30 side.

The nozzle 30 is constituted by a tapered portion 42, in which a cross-section area is gradually reduced from the upstream side connected to the cavity 37 toward the downstream side, and an opening portion 43 which communicates with the tapered portion 42 and also is opened at the nozzle formation face 26*a*. If ink is filled in the nozzle 30 from the upstream side, a meniscus M is formed in the nozzle 30 and in the vicinity of a nozzle orifice 44 opened at the nozzle formation face 26*a*. The meniscus M is a curved surface in which the central portion of ink can rise due to capillarity so as to form a concave face shape as viewed from the nozzle orifice 44.

As shown in FIG. 2, in the ink cartridge 31, an ink pack 46 containing ink and having flexibility is housed in a case 47. A pressurizing pump 49 is connected to the case 47 through an air flow path 48 and also the upstream end of the ink flow path 32 is connected to the ink pack 46. Therefore, if the pressurizing pump 49 supplies air into the case 47 through the air flow path 48, the ink pack 46 is crushed, so that ink in the ink pack 46 is supplied to the ink flow path 32.

In the ink flow path 32, at a pressure-adjusting position PT as a second position, a one-way valve 51 is provided which allows passage of ink from the upstream side to the downstream side in accordance with decompression on the downstream side, thereby adjusting pressure in the ink flow path 32. The one-way valve 51 includes a storage chamber 52 which primarily stores ink pressurized and supplied from the ink cartridge 31, and a pressure chamber 53 which is located further on the downstream side than the storage chamber 52. The storage chamber 52 and the pressure chamber 53 are separated by a partition wall portion 54 and communicate with each other by the movement in a valve opening direction of a valve body 56, which is biased in a valve closing direction by a spring 55, thereby coming into contact with the partition wall portion 54.

For this reason, if ink is ejected from the nozzle 30, thereby being consumed, the inside of the pressure chamber 53 is decompressed, so that a film 57 is bent and deformed to the pressure chamber 53 side on the basis of the differential pressure between the pressure chamber 53 and the atmosphere. If the bending force becomes larger than the biasing force of the spring 55, the valve body 56 moves to a valve opening position, in which the valve body 56 is separated from the partition wall portion 54, so that the pressurized ink in the storage chamber 52 flows to the pressure chamber 53 side. If ink flows into the pressure chamber 53, whereby the chamber pressure thereof is increased, the biasing force of the spring 55 overcomes, whereby the valve body 56 moves to a valve closing position in which the valve body 56 comes into contact with the partition wall portion 54 again.

In this manner, the one-way valve 51 is opened by decompression further on the downstream side than the valve body 56, whereas, in a case where the upstream side is pressurized, the valve body 56 is forced in a closing direction, so that a valve closing state is maintained without valve opening. Also in a case where the downstream side is pressurized, similarly, since the film 57 is bent and deformed in a direction increasing the volume of the pressure chamber 53, the valve body 56 maintains a valve closing state without receiving a force in a valve opening direction from the film 57. Further, since ink on the upstream side remains pressurized by the pressurizing pump 49, the upstream side further than the valve body 56 is not decompressed. The one-way valve 51 is a valve which is opened only when the downstream side is decompressed.

A portion of the pressure chamber 53 is constituted by the film 57 made of a flexible material (for example, synthetic resin, rubber, or the like) and for example, a cantilevered metal fragment (for example, a piece of a metal fragment of a comb-tooth shape) (not shown) capable of being deformed along with the film 57 is disposed at a contact place of the valve body 56.

A maintenance pump 61 as a pump which changes pressure in the ink flow path 32, thereby allowing ink to be suctioned and discharged, is connected to a pressure-changing position PH as a first position which is further on the downstream side than the pressure-adjusting position PT.

The maintenance pump 61 is a pump capable of pressurizing ink in the recording head 26. The pressurizing pump 49 is provided separately from the maintenance pump 61. However, pressurization by the pressurizing pump 49 is blocked by the one-way valve 51, so that the pressurizing force cannot be transmitted to the recording head 26. Accordingly, in order to perform maintenance of the recording head 26, the maintenance pump 61 capable of pressurizing ink in the recording head 26 is required separately from the pressurizing pump 49.

Figure 4:
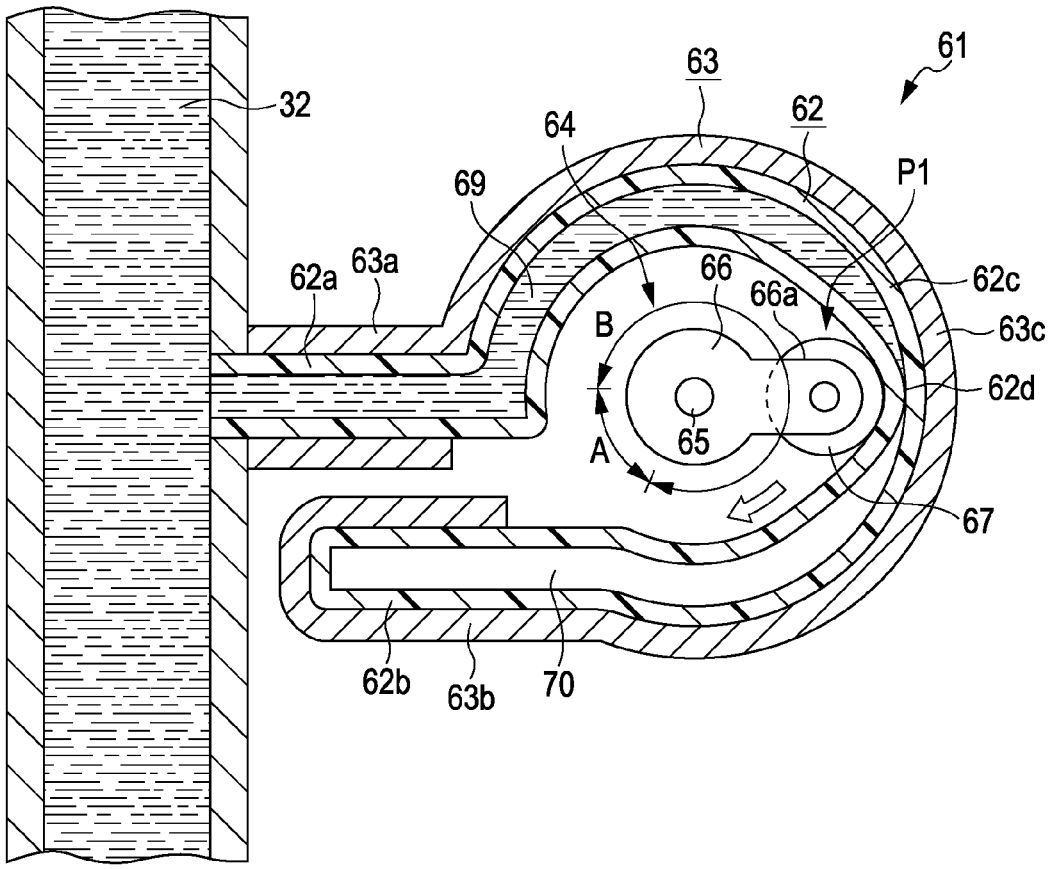
FIG. 4 is a schematic diagram of a maintenance pump in a standby state.

As shown in FIG. 4, the maintenance pump 61 includes a tube 62 having flexibility, a frame body 63 supporting the tube 62, and a pressing mechanism 64 capable of pressing the tube 62. A base end portion 62*a* of the tube 62 is connected to the ink flow path 32, whereas a leading end portion 62*b* of the tube 62 is blocked.

The frame body 63 has a base end support portion 63*a*, a leading end support portion 63*b*, and an intermediate support portion 63*c*, which respectively support the base end portion 62*a*, the leading end portion 62*b*, and an intermediate portion 62*c* of the tube 62. The base end support portion 63*a* and the leading end support portion 63*b* of the frame body 63 are formed into a tubular shape so as to support the base end portion 62*a* and the leading end portion 62*b* of the tube 62 in a state where the end portions are inserted therein. The intermediate support portion 63*c* of the frame body 63 is a plate-like body connecting the base end support portion 63*a* and the leading end support portion 63*b* and is formed to be curved in a circular arc shape in a cross section so as to support the intermediate portion 62*c* of the tube 62 from the outer circumference side thereof in a state where the intermediate portion 62*c* is curved in a circular arc shape.

The pressing mechanism 64 is disposed at a position on the inner side (inner circumference side) of the intermediate portion 62*c* of the tube 62 supported by the intermediate support portion 63*c* of the frame body 63 in a state where the intermediate portion 62*c* is curved in a circular arc shape. The pressing mechanism 64 includes a rotating plate 66 rotatable around a driving shaft 65, and a pressing roller 67 rotatably provided at a leading end portion of a tongue portion 66*a* protruding outward in the radial direction of the rotating plate 66. The pressing roller 67 is disposed to be capable of clamping the tube 62 so as to crush the tube 62 in cooperation with the intermediate support portion 63*c* by pressing the intermediate portion 62*c* of the tube 62 from the inner circumference side toward the intermediate support portion 63*c* side of the frame body 63.

For this reason, the inside of the tube 62 (specifically, the intermediate portion 62*c*) is sectioned into an ink chamber 69 as a liquid chamber which is on the base end portion 62*a* side, and a gas chamber 70 which is on the leading end portion 62*b* side, with a pressing point 62*d* crushed by the pressing roller 67 and the intermediate support portion 63*c* of the frame body 63 as a boundary. The ink chamber 69 communicates with the ink flow path 32, thereby being filled with ink. On the other hand, in the gas chamber 70, gas (for example, air) is contained.

If the driving shaft 65 rotates in accordance with the driving of a pressing motor 68 (refer to FIG. 2), the pressing roller 67 rotates along with the rotating plate 66 in a direction (the clockwise direction) indicated by a white arrow in FIG. 4. If the pressing roller 67 rotationally moves in a state where it has crushed the tube 62, the pressing point 62*d* moves in a direction in which the volume of the ink chamber 69 is increased and also the volume of the gas chamber 70 is reduced. Therefore, the pressing roller 67 serves as a volume changing section which changes the volumes of the ink chamber 69 and the gas chamber 70.

Figure 5:
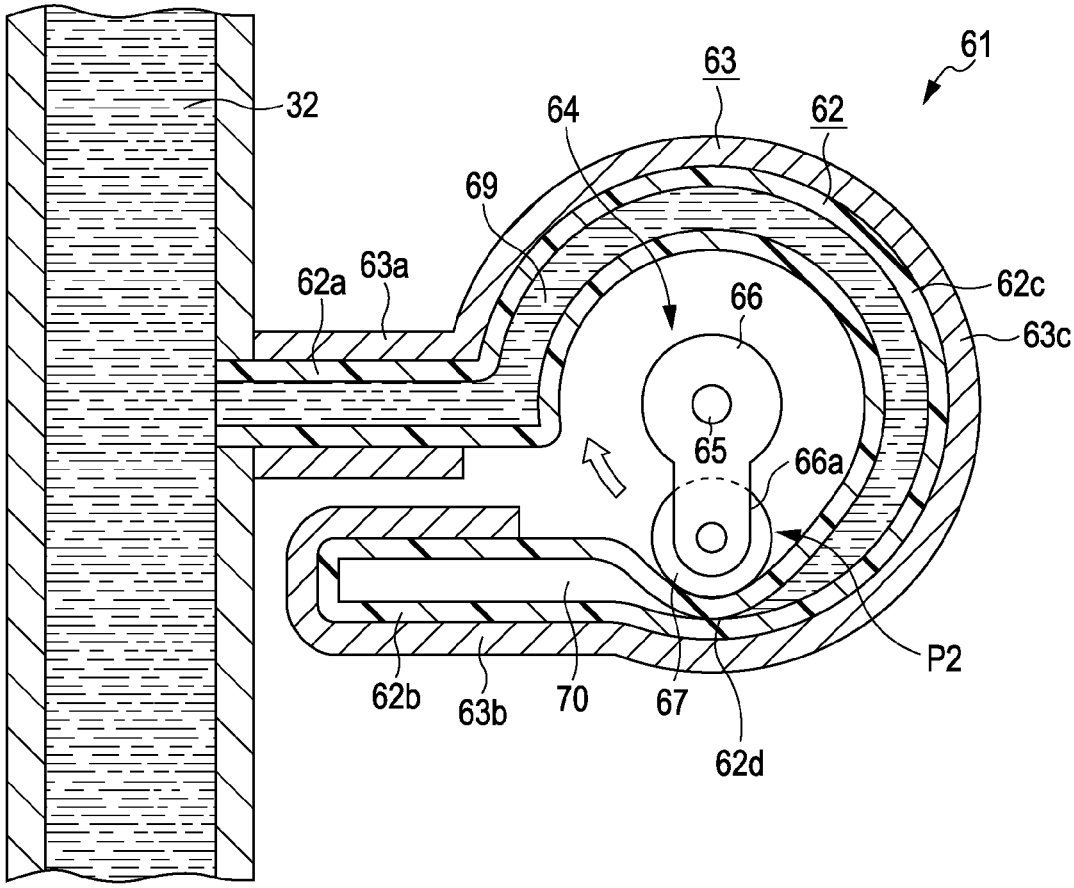
FIG. 5 is a schematic diagram of the maintenance pump at the time of the end of suction driving.

Specifically, when the pressing roller 67 which is located at a standby position P1, as shown in FIG. 4, rotationally moves up to a suction ending position P2 shown in FIG. 5, the volume of the ink chamber 69 is increased, so that ink is suctioned from the inside of the ink flow path 32. On the other hand, the volume of the gas chamber 70 is reduced, so that the contained gas is compressed.

For this reason, if the pressing roller 67 rotationally moves additionally from the suction ending position P2, thereby being located at a non-clamping area A, a clamped state of the tube 62 is released, so that the pressure of the compressed air contained in the gas chamber 70 acts on ink in the ink chamber 69. For this reason, the ink is pushed by the gas, thereby moving to the base end portion 62*a* side and then being discharged into the ink flow path 32. The non-clamping area A is at a position where the pressing roller 67 does not face the intermediate support portion 63*c* through the tube 62.

Figure 6:
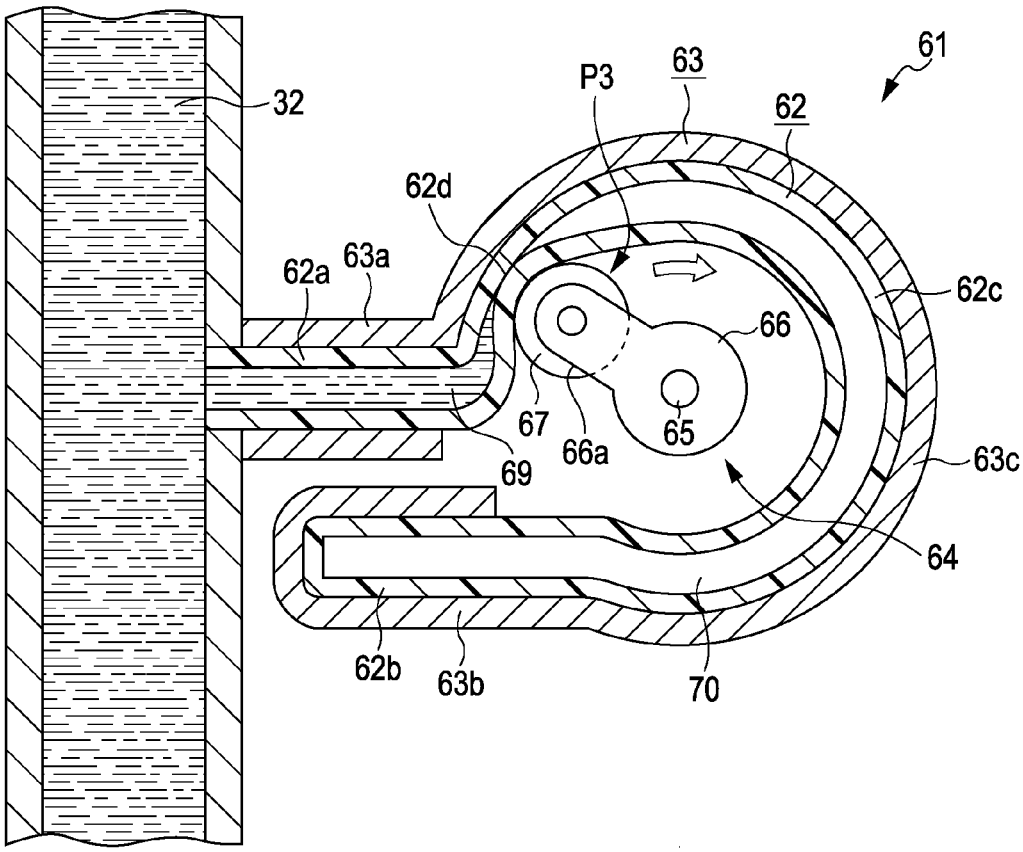
FIG. 6 is a schematic diagram of the maintenance pump at the time of the start of the suction driving.

If the pressing roller 67 rotationally moves additionally, thereby moving up to a clamping area B where the pressing roller 67 can clamp the tube 62 along with the intermediate support portion 63*c*, as shown in FIG. 6, the pressing roller 67 presses the tube 62 against the intermediate support portion 63*c*, thereby clamping the tube 62. The clamping area B is at a position where the pressing roller 67 faces the intermediate support portion 63*c* through the tube 62 and presses the tube 62 against the intermediate support portion 63*c*, thereby being capable of clamping the tube 62. The pressing roller 67 rotationally moves additionally from a suction starting position P3 shown in FIG. 6, whereby ink in the ink flow path 32 is suctioned into the ink chamber 69.

Therefore, the maintenance pump 61 performs discharge driving and suction driving by the rotational driving of the driving shaft 65 by the pressing motor 68. In this embodiment, the thickness and the length of the tube 62 are set such that the volume of the tube 62 between the suction starting position P3 and the standby position P1 becomes equal to or greater than the amount of change in volume of the pressure chamber 53 accompanying the displacement of the film 57.

Further, as shown in FIG. 2, at the printer 11, a control section 72 as a control unit which performs overall control of the operation status of the printer 11 is provided. The control section 72 controls the driving of the piezoelectric element 40 provided at each of the recording heads 26 to 29, the pressuring pump 49, and the pressing motor 68, thereby performing printing and cleaning processes.

Next, an action in the printer 11 constituted as described above will be described below.

Now, if printing is started in the printer 11, the control section 72 creates ejection timing for each nozzle 30 on the basis of printing data and also drives the piezoelectric element 40 on the basis of the ejection timing. Then, the vibration plate 39 is displaced in a direction reducing the volume of the cavity 37, thereby ejecting ink from the nozzle 30. Ink ejected from each nozzle 30 adheres to the paper 12 which is supported on and transported by the transport belt 22, whereby printing is carried out on the paper 12.

If ink is consumed by ejection from the nozzle 30, decompression accompanying a reduction in ink is transmitted to the one-way valve 51 through the reservoir 36 and the ink flow path 32. Then, the valve body 56 moves to a valve opening position against the biasing force of the spring 55, so that ink in the storage chamber 52 flows to the pressure chamber 53 side. If ink flows into the pressure chamber 53, whereby the chamber pressure thereof is increased, the biasing force of the spring 55 overcomes, whereby the valve body 56 moves to a valve closing position again.

Therefore, since the one-way valve 51 is made so as to allow passage of ink from the upstream side to the downstream side in accordance with decompression on the downstream side, ink corresponding to the consumed amount is supplied from the ink cartridge side. Therefore, even if ink is ejected from the nozzle in accordance with printing, the position of the meniscus M is located in the vicinity of the nozzle orifice 44, as shown in FIG. 3.

Incidentally, if a period in which printing is not carried out, so that ink is not ejected from the nozzle, becomes longer, sometimes, ink evaporates from the nozzle orifice 44, whereby ink is thickened or the position of the meniscus M rises. The rising of the position of the meniscus M sometimes occurs also in other situations such as a case where the printer 11 is subjected to a shock or a case where an end of the paper 12 comes into contact with the nozzle orifice 44, as well as the time of evaporation of ink.

Therefore, the control section 72 carries out a cleaning process, for example, in a case where a cleaning process execution command from a user is received from an operation section (not shown) or a case where a decision is made that a predetermined time has passed from a cleaning process of the previous time. At the time of printing or standby, which become the time of a non-cleaning process, the pressing roller 67 of the maintenance pump 61 is set to be located at the standby position P1 in the clamping area B.

The control section 72 drives the pressing motor 68, thereby rotating the pressing roller 67 by one revolution around the driving shaft 65. The pressing roller 67 which is located at the standby position P1 moves to the suction ending position P2 side and then passes through the non-clamping area A and the suction starting position P3, thereby returning to the standby position P1.

During movement from the standby position P1 up to the suction ending position P2, since the volume of the ink chamber 69 is increased, the maintenance pump 61 performs suction driving, thereby suctioning ink from the ink flow path 32 (the first suctioning).

Figure 7:
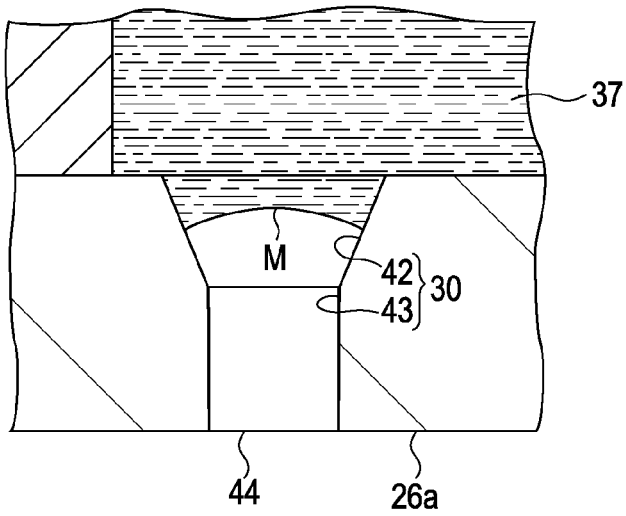
FIG. 7 is a schematic diagram of a nozzle at the time of the suction driving of the maintenance pump.

If the maintenance pump 61 performs the suction driving, further at the downstream side than the pressure-changing position PH in the ink flow path 32, ink is suctioned from the nozzle 30 side. Therefore, the meniscus M located in the vicinity of the nozzle orifice 44 rises in position, as shown in FIG. 7, and also, in the nozzle 30 in which the position of the meniscus M has risen originally, the position further rises. Negative pressure accompanying the suction driving of the maintenance pump 61 also acts further on the upstream side than the pressure-changing position PH. For this reason, the film 57 is displaced in a direction in which the volume of the pressure chamber 57 is reduced, thereby opening the one-way valve 51, so that ink is also supplied from the ink cartridge 31 side.

Now, if the pressing roller 67 rotationally moves additionally from the suction ending position P2, thereby moving to the non-clamping area A, the maintenance pump 61 performs the discharge driving. The pressure of gas in the gas chamber 70 acts on ink in the ink chamber 69, so that ink in the ink chamber 69 is discharged into the ink flow path 32 (discharging).

Incidentally, the one-way valve 51 provided further at the upstream side than the pressure-changing position PH in the ink flow path 32 is opened when it is decompressed from the downstream side, whereas the one-way valve 51 maintains a valve closing state when it is pressurized from the downstream side. For this reason, if ink is discharged from the maintenance pump 61, since the one-way valve 51 remains closed, ink is supplied to the nozzle 30 side which is further on the downstream side than the pressure-adjusting position PT. Ink that the maintenance pump 61 discharges in accordance with the discharge driving is the sum of ink filled in the ink chamber 69 in a case where the pressing roller 67 is located at the standby position P1 and ink suctioned in the first suctioning. Further, since ink is also suctioned from the ink cartridge 31 side at the time of the suction driving, the amount of ink which is supplied to the nozzle 30 side at the time of the discharge driving is larger than the amount of ink suctioned from the nozzle 30 side in the first suctioning.

Figure 8:
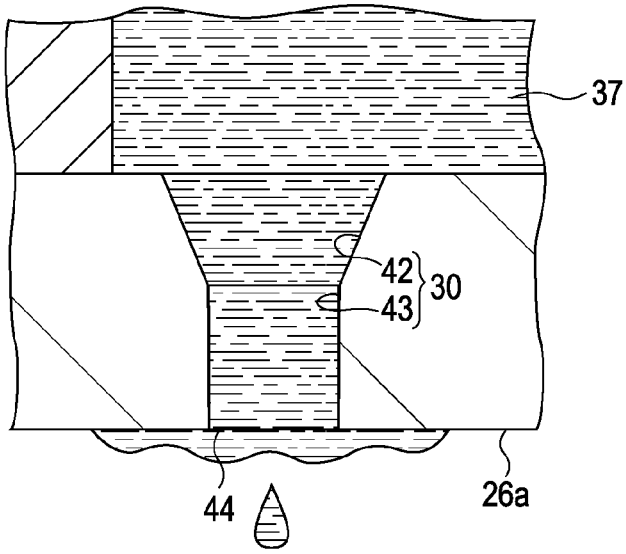
FIG. 8 is a schematic diagram of the nozzle at the time of the discharge driving of the maintenance pump.

Therefore, if the maintenance pump 61 performs the discharge driving, ink thickened in the vicinity of the nozzle orifice 44 or ink in which air bubbles are mixed therein is discharged along with ink supplied form the maintenance pump 61 side, so that cleaning of the recording head 26 is performed. Incidentally, if ink is discharged from the nozzle 30 in accordance with the cleaning, ink sometimes adheres to the nozzle formation face 26*a* in the vicinity of the nozzle orifice 44 (refer to FIG. 8).

Further, at the time of the discharge driving of the maintenance pump 61, the discharge pressure of the maintenance pump 61 acts on the pressure chamber 53, so that the film 57 is bent and deformed to the atmospheric pressure side, thereby increasing the volume of the pressure chamber 53. For this reason, in the pressure chamber 53, in which the volume is increased, whereby a pressurizing force is accumulated, negative pressure cannot be applied to ink and further the accumulated pressurizing force is transmitted to the nozzle 30 side, so that there is also a possibility that discharge of ink from the nozzle 30 may be continued.

However, the pressing roller 67 passes through the non-clamping area A and also rotationally moves to the suction starting position P3 which is further on the base end portion 62*a* side than the suction ending position P2, thereby crushing the tube 62. Further, the control section 72 stops the driving of the pressing motor 68 at the timing when the pressing roller 67 is located at the standby position P1. During the movement of the pressing roller 67 from the suction starting position P3 up to the standby position P1, since the volume of the ink chamber 69 is increased, the maintenance pump 61 performs the suction driving, thereby suctioning ink from the ink flow path 32 (the second suctioning).

Figure 9:
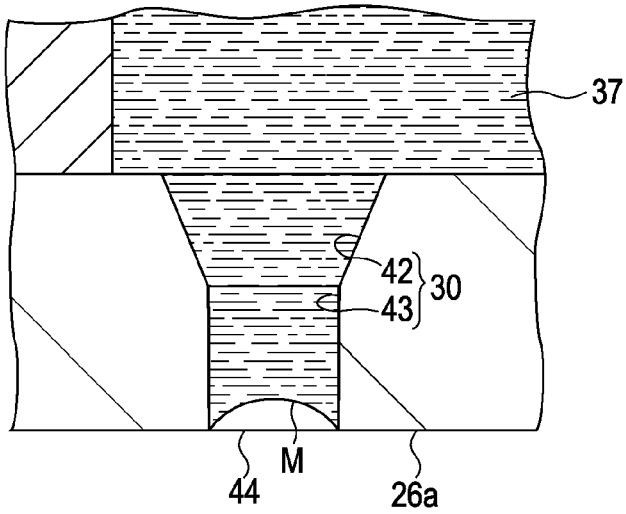
FIG. 9 is a schematic diagram of the nozzle after the end of cleaning.

Then, further at the downstream side than the pressure-changing position PH, since ink is suctioned from the nozzle 30 side, ink adhered to the vicinity of the nozzle orifice 44 is suctioned into the nozzle 30. Further at the upstream side than the pressure-changing position PH, since ink in the pressure chamber 53 is suctioned, the film 57 is bent and deformed to the storage chamber 52 side, so that a pressurized state is released. Incidentally, in this embodiment, the volume of the tube 62 between the suction starting position P3 and the standby position P1 is set to be equal to or more than the amount of change in the volume of the pressure chamber 53 accompanying the displacement of the film 57. For this reason, in a case where ink larger than the amount of change in the volume of the pressure chamber 53 is suctioned in accordance with the suction driving of the maintenance pump 61, the one-way valve 51 is opened, whereby ink is supplied from the ink cartridge 31 side. Therefore, as shown in FIG. 9, the meniscus M is located in the vicinity of the nozzle orifice 44.

According to the above-described embodiment, the following effects can be obtained.

(1) By the discharge driving of the maintenance pump 61, the cleaning process can be performed in which ink is supplied to the nozzle 30 side through the ink flow path 32 and then discharged from the nozzle 30. At this time, since the maintenance pump 61 discharges ink into the ink flow path 32 at the pressure-changing position PH, discharge pressure also acts on the pressure chamber 53 of the one-way valve 51 provided at the pressure-adjusting position PT. Then, while the one-way valve 51 maintains a closed state, the pressure chamber 53 expands, thereby accumulating a pressurizing force. However, since the maintenance pump 61 performs the suction driving after the discharge driving, it is possible to suppress transmission of the pressurizing force to the nozzle 30 side by suctioning ink in the ink flow path 32, thereby contracting the pressure chamber 53. Therefore, it is possible to perform the cleaning where the consumption of ink after the end of the cleaning is suppressed.

(2) In a case where the viscosity of ink has risen or a case where air bubbles have been mixed in ink, the fluidity of ink decreases. In that respect, it is possible to vigorously discharge ink into the ink flow path 32 by compressing gas in the gas chamber 70 and also providing the pressure of the compressed gas to ink in the ink chamber 69. Since it is not necessary to provide an accumulating configuration of the pressurizing force of the maintenance pump 61, such as a valve, at the ink flow path 32, an increase in the number of parts is suppressed, so that it is possible to speed up the flow velocity of ink.

(3) Since it is possible to contract the pressure chamber 53 expanded in accordance with the discharge driving of the maintenance pump 61 so as to become a minimal volume by the suction driving of the maintenance pump 61, it is possible to suppress transmission of the pressurizing force to the nozzle 30 side. In a case where the maintenance pump 61 has suctioned ink equal to or more than the amount of change of the pressure chamber 53, since the inside of the pressure chamber 53 is decompressed, the one-way valve 51 is opened, so that ink is supplied from the upstream side into the pressure chamber 53. For this reason, it is possible to suppress the consumption of ink after the cleaning and also adjust pressure further on the downstream side than the one-way valve 51 in the ink flow path 32.

(4) Ink suctioned by the movement of the pressing roller 67 from the suction starting position P3 up to the standby position P1 at the time of the cleaning of the previous time can be used in cleaning. Since in the case of performing cleaning, it is not necessary to suction all the amount of ink required for the cleaning, it is possible to promptly perform the cleaning.

In addition, the above-described embodiment may be modified as follows.

In the above-described embodiment, a configuration is also acceptable in which the pressing roller 67 is located at the suction ending position P2 at the time of non-cleaning and at the time of cleaning, the pressing roller 67 is rotated by one revolution around the driving shaft 65 from the suction ending position P2. The maintenance pump 61 may be made to wait in a state where the volume of the ink chamber 69 is increased and also a state where the volume of the gas chamber 70 is reduced, whereby gas is compressed. In this case, if the control section 72 drives the pressing motor 68, the pressing roller 67 moves to the non-clamping area A, whereby the maintenance pump 61 performs the discharge driving. Subsequently, since the pressing roller 67 moves in the clamping area B in a state where it has crushed the tube 62, the volume of the ink chamber 69 is gradually increased, so that ink is suctioned from the ink flow path 32. The pressurizing force remaining in the ink flow path 32 can be recovered by performing the suction driving of the maintenance pump 61 after the discharge driving.

In the above-described embodiment, in the maintenance pump 61, the volume of the tube 62 between the suction starting position P3 and the suction ending position P2 may be set so as to become equal to or more than the amount of change in volume accompanying the displacement of the film 57 of the pressure chamber 53. At the time of the discharge driving before the maintenance pump 61 stops, it is preferable to suction ink to the extent capable of recovering the pressurizing force accumulated in the pressure chamber 53.

In the above-described embodiment, the maintenance pump 61 may be a piston pump or a diaphragm pump which changes the volume of the ink chamber by the displacement of a diaphragm. The volumes of the ink chamber and the gas chamber may be changed in accordance with the movement of a piston or a diaphragm. The maintenance pump 61 may be constituted to be a gear pump or a vane pump, which has an ink containing chamber, and move ink from the ink flow path 32 to the ink containing chamber in the case of performing the suction driving and ink from the ink containing chamber to the ink flow path 32 in the case of performing the discharge driving.

In the above-described embodiment, the maintenance pump 61 may perform the suction driving and the discharge driving by reciprocating the pressing roller 67 with the clamping state of the tube 62 maintained by the pressing roller 67 and the intermediate support portion 63*c*. The control section 72 controls the pressing motor 68 so as to reciprocate the pressing roller 67 in the clamping area B. Then, the maintenance pump 61 performs the suction driving in a case where the pressing roller 67 moves in the clockwise direction in FIG. 4 from the suction starting position P3 to the suction ending position P2 and performs the discharge driving in a case where the pressing roller 67 moves in the counterclockwise direction from the suction ending position P2 to the suction starting position P3. In a case where the pressing roller 67 reciprocates in the clamping area B, a configuration is also acceptable in which the leading end portion 62*b* of the tube 62 is opened, so that the gas chamber 70 is not provided.

In the above-described embodiment, the frame body 63 may support the tube 62 in a linear fashion, and if the pressing point 62*d* can be changed in a state where the tube 62 is crushed, the clamping section can be arbitrarily changed. For example, the tube 62 may be clamped by a pair of pressing rollers.

In the above-described embodiment, the cleaning process may be performed by rotating more than once the pressing roller 67 around the driving shaft 65. For example, in a case where the degree of the thickening of ink or the degree of the rising of the position of the meniscus M is high, there is a fear that restoration does not occur in single discharge driving of the maintenance pump 61. In that respect, it is possible to restore the state of the nozzle 30 by carrying out the discharge driving more than once. Even in a case where the maintenance pump 61 is driven more than once, by performing the suction driving between the discharge driving processes, it is possible to suppress the overflowing of ink from the nozzle 30 at the time of the suction driving. By stopping the pressing roller 67 at the standby position P1, it is possible to suppress the overflowing of ink from the nozzle 30 even after the end of the cleaning, because it is possible to stop the maintenance pump 61 after the suction driving.

In the above-described embodiment, the maintenance pump 61 may be connected to the reservoir 36 to suction and discharge ink in the reservoir 36. The pressure-changing position PH where the maintenance pump 61 is connected may be arbitrarily set between the pressure-adjusting position PT and the branching position PB.

Second Embodiment

Figure 10:
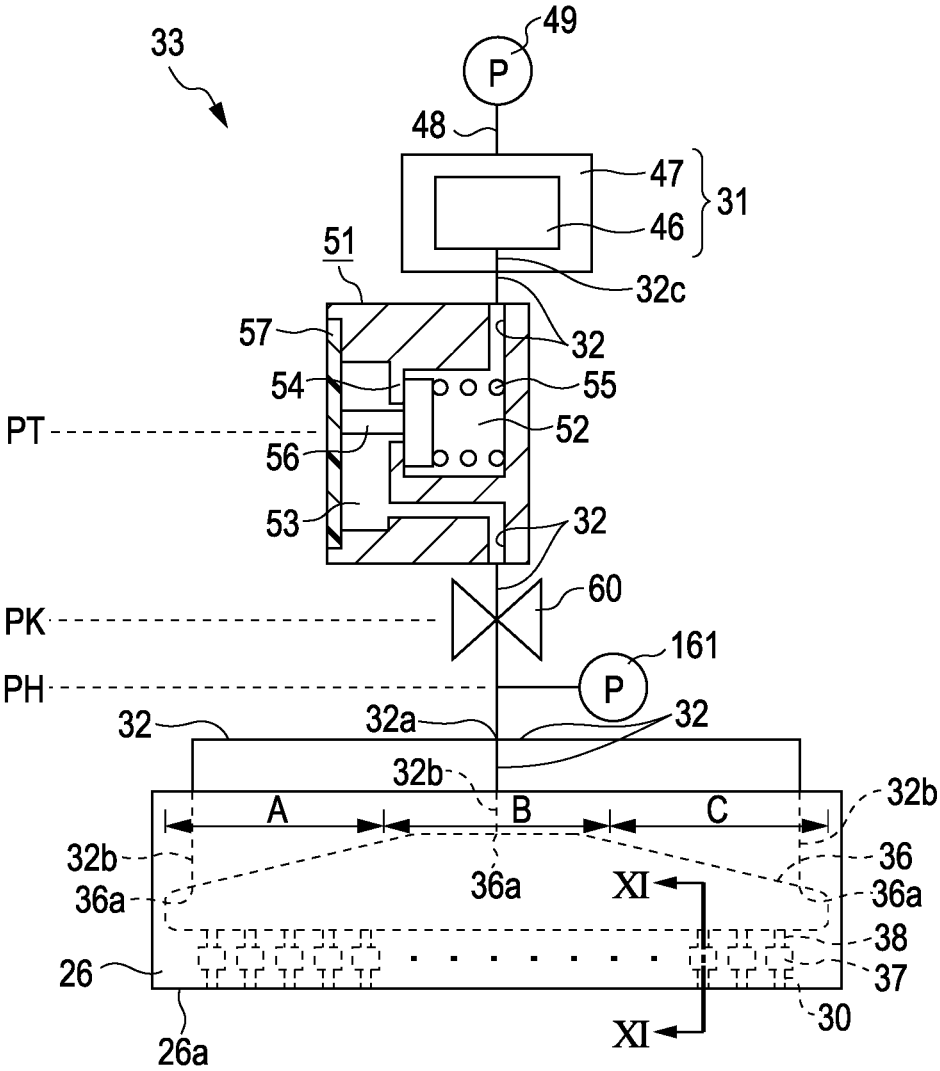
FIG. 10 is a schematic diagram of an ink supply system of a second embodiment.

FIG. 10 shows a schematic diagram of an ink supply system related to a second embodiment. At a position in the vicinity of each of the recording heads 26 to 29, a wiper 34 (refer to FIG. 14) capable of coming into contact with each of the nozzle formation faces 26*a* to 29*a*, and a wiping mechanism 35 (refer to FIG. 13) which moves the wiper 34 along each of the nozzle formation faces 26*a* to 29*a* are provided. The wiping mechanism 35 performs wiping which sweeps each of the nozzle formation faces 26*a* to 29*a* by the wiper 34 by moving the wiper 34 in a state where the wiper 34 has come into contact with each of the nozzle formation faces 26*a* to 29*a*. Therefore, the wiping mechanism 35 functions as a wiping section.

Figure 11:
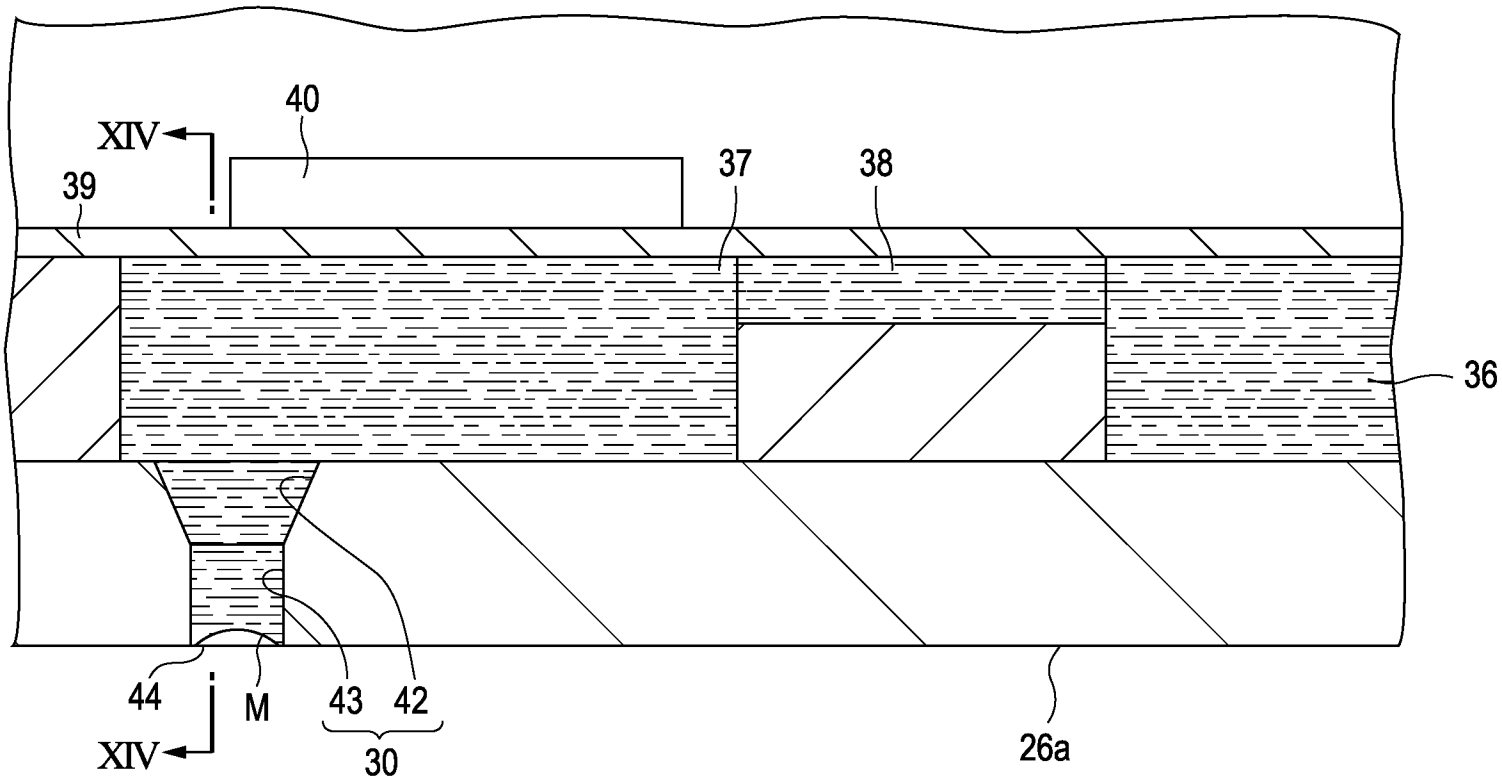
FIG. 11 is a sectional schematic diagram as viewed in the direction of the arrow XI-XI of FIG. 10.

As shown in FIGS. 10 and 11, in the first recording head 26, the reservoir 36 as a liquid supply chamber is formed so as to extend in the front-and-back direction along the row of nozzles, similarly to the first embodiment. In the reservoir 36, at least one connection port 36*a* is formed for each of a plurality of areas (in this embodiment, three areas A to C) sectioned at least in the longitudinal direction (the front-and-back direction) of the reservoir 36. A plurality of downstream ends 32*b* of the ink flow path 32 branched at a branching portion 32*a* is respectively connected to each connection port 36*a*.

It is preferable that the reservoir 36 be sectioned into the same number (in this embodiment, three) of areas A to C as the number of the downstream ends 32*b* of the ink flow path 32 which is connected thereto and further that the respective areas A to C have equal intervals in the front-and-back direction. For example, in a case where the shape of the reservoir 36 is line-symmetrical or point-symmetrical in the front-and-back direction, it is preferable that the areas A to C be sectioned so as to become line-symmetrical or point-symmetrical. It is preferable that the connection ports 36*a* be also formed so as to become line-symmetrical or point-symmetrical. In a case where a plurality of connection ports 36*a* is formed in one area, it is preferable to form the same number of connection ports 36*a* in the respective areas A to C.

As shown in FIG. 10, an upstream end 32*c* of the ink flow path 32 is connected to the ink pack 46. For this reason, if the pressurizing pump 49 supplies air into the case 47 through the air flow path 48, the ink pack 46 is crushed, so that ink in the ink pack 46 is supplied to the ink flow path 32.

In the ink flow path 32, at a opening and closing position PK which is further on the downstream side than the pressure-adjusting position PT where the one-way valve 51 is provided, a flow path valve 60 capable of opening and closing the ink flow path 32 is provided. Further, a maintenance pump 161 as a pump which changes pressure in the ink flow path 32, thereby being capable of suctioning and discharging ink, is connected to the pressure-changing position PH as a connection position which is further on the downstream side than the opening and closing position PK and further on the upstream side than the branching portion 32*a* of the ink flow path 32.

Figure 12:
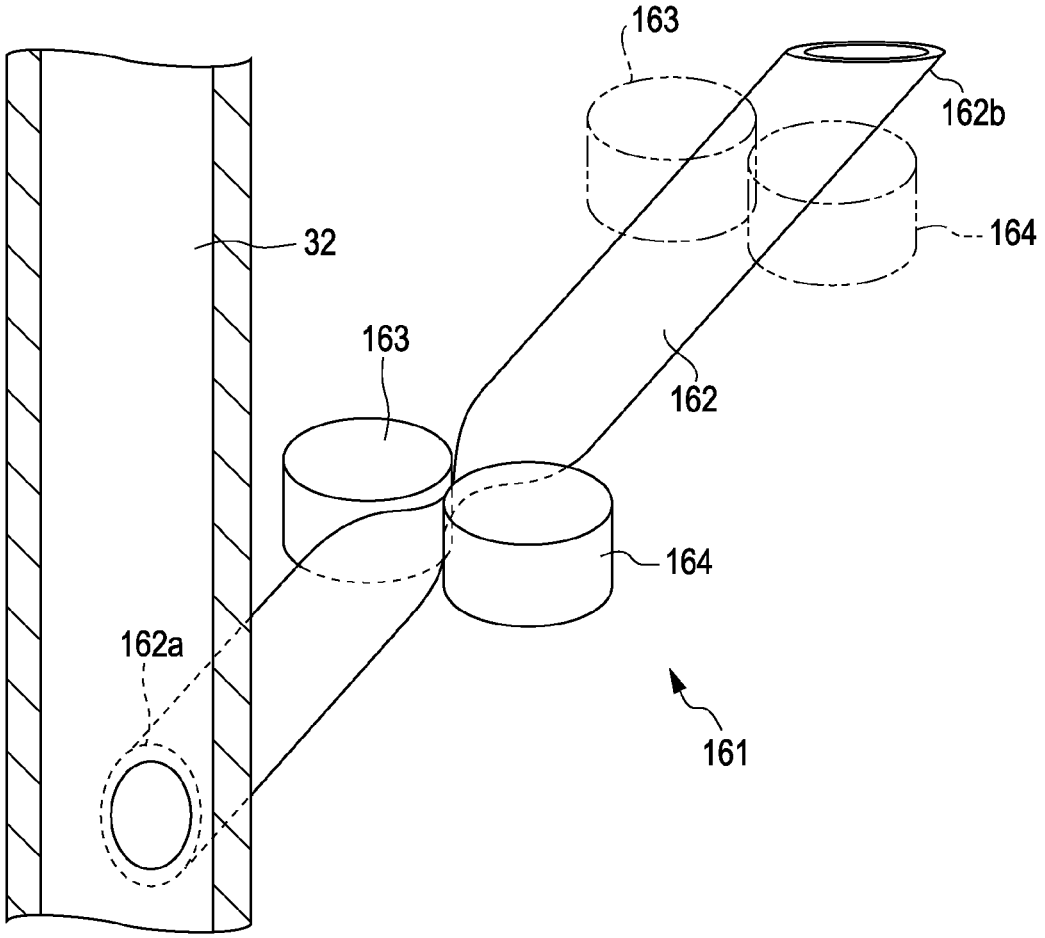
FIG. 12 is a schematic diagram of a maintenance pump of the second embodiment.

As shown in FIG. 12, the maintenance pump 161 includes a tube 162 having flexibility, and a pair of pressing rollers 163 and 164. A base end portion 162*a* of the tube 162 is connected to the ink flow path 32, whereas a leading end portion 162*b* of the tube 162 is opened. The pair of pressing rollers 163 and 164 is disposed in a state where they clamp the tube 162 so as to crush the tube 162 from both sides. The maintenance pump 161 is provided with a movement mechanism 165 (refer to FIG. 13) which reciprocates the pressing rollers 163 and 164 between a discharge position shown by a solid line in FIG. 12 and a suction position shown by a two-dotted and dashed line.

By the movement of the pressing rollers 163 and 164, which are located at the discharge position that is on the base end portion 162*a* side of the tube 162, to the suction position side that is further on the leading end portion 162*b* side than the discharge position, ink in the ink flow path 32 is suctioned into the tube 162. By the movement of the pressing rollers 163 and 164 which are located at the suction position to the discharge position side, ink in the tube 162 is pushed by the pressing rollers 163 and 164, thereby being discharged to the ink flow path 32. Therefore, the maintenance pump 161 performs the suction driving and the discharge driving by the movement of the pressing rollers 163 and 164 by the movement mechanism 165.

Figure 13:
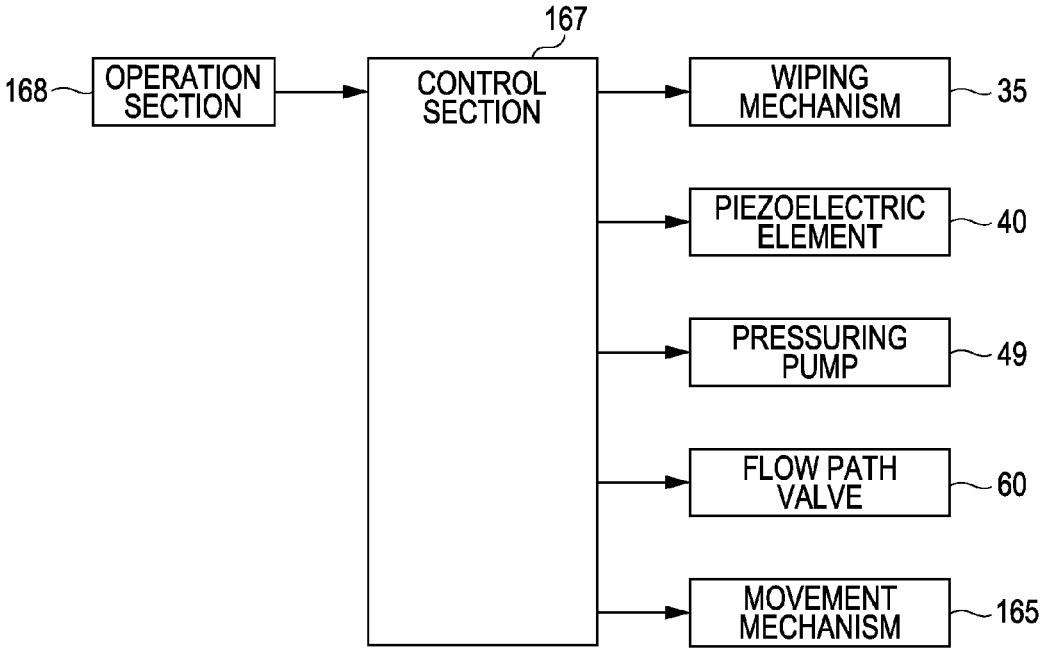
FIG. 13 is a block diagram of a control section.

Further, as shown in FIG. 13, at the printer 11, a control section 167 as a control unit which performs overall control of the operation status of the printer 11 is provided. The control section 167 controls the driving of the wiping mechanism 35, the piezoelectric element 40, the pressurizing pump 49, the flow path valve 60, and the movement mechanism 165 in accordance with an input from an operation section 168 by a user, thereby performing printing and wiping processes.

Next, an action in the printer 11 constituted as described above will be described below.

Now, if printing is started in the printer 11, the control section 167 creates ink ejection timing for each nozzle 30 on the basis of printing data and also drives the piezoelectric element 40 on the basis of the ejection timing. Then, the vibration plate 39 is displaced in a direction reducing the volume of the cavity 37, thereby ejecting ink from the nozzle 30. Ink ejected from each nozzle 30 adheres to the paper 12 which is supported on and transported by the transport belt 22, whereby printing is carried out on the paper 12.

The flow path valve 60 maintains a valve opening state at the time of printing. For this reason, if ink is ejected from the nozzle 30, thereby being consumed, decompression accompanying a reduction in ink is transmitted to the one-way valve 51 through the reservoir 36 and the ink flow path 32, so that the film 57 is bent and deformed to the pressure chamber 53 side on the basis of a differential pressure between the pressure chamber 53 and the atmosphere. Then, the valve body 56 moves to a valve opening position against the biasing force of the spring 55, so that ink in the storage chamber 52 flows to the pressure chamber 53 side. If ink flows into the pressure chamber 53, whereby the chamber pressure thereof is increased, the biasing force of the spring 55 overcomes, whereby the valve body 56 moves to a valve closing position again.

Therefore, since the one-way valve 51 is made so as to allow passage of ink from the upstream side to the downstream side in accordance with decompression on the downstream side, ink corresponding to the consumed amount is supplied from the ink cartridge side. Therefore, even if ink is ejected from the nozzle 30 in accordance with printing, the position of the meniscus M is located in the vicinity of the nozzle orifice 44, as shown in FIG. 11.

Incidentally, if printing is performed by transporting the paper 12 and also ejecting ink from the nozzle 30, ink mist or paper dust scattered in accordance with the ejection of ink adheres to the nozzle formation face 26*a*.

For this reason, the control section 167 carries out a wiping process in a case where a wiping process execution command from a user is received from the operation section 168 or a case where a decision is made that the sweeping of the nozzle formation face 26*a* is required just after the cleaning process of discharging ink from the nozzle 30, or the like. At the time of printing or standby, which becomes the time of a non-wiping process, a setting is made such that the pressing rollers 163 and 164 of the maintenance pump 161 are located at the discharge position and also the flow path valve 60 is opened.

Now, in the case of carrying out the wiping process, first, the control section 167 closes the flow path valve 60 and also drives the movement mechanism 165, thereby moving the pressing rollers 163 and 164 to the suction position side. For this reason, the maintenance pump 161 performs suction driving, thereby suctioning ink further from the downstream side than the flow path valve 60 (suctioning).

Figure 14:
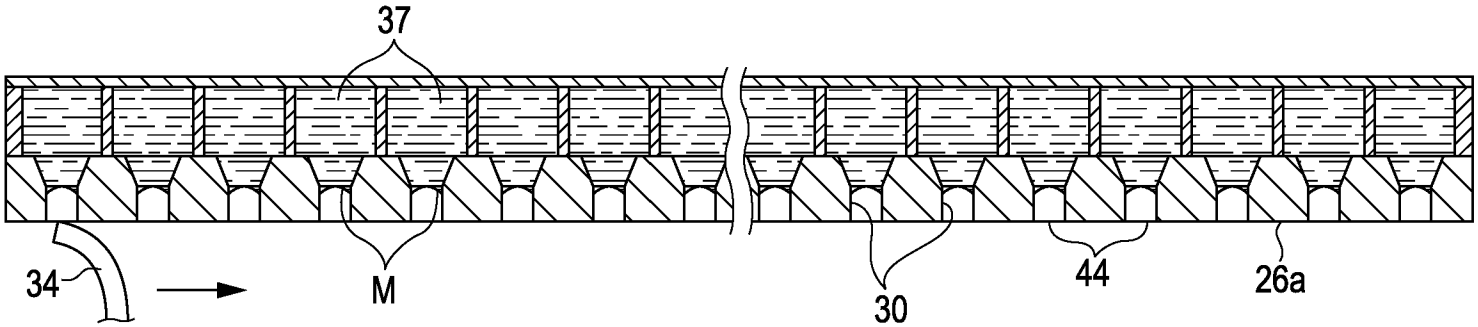
FIG. 14 is a sectional schematic diagram as viewed in the direction of the arrow XIV-XIV of FIG. 11.

Then, the position of the meniscus M which has been located in the vicinity of the nozzle orifice 44 rises as shown in FIG. 14. In this embodiment, suction power is provided to plural positions in the reservoir 36 through the ink flow path 32 branched at the branching portion 32*a*. For this reason, since ink is suctioned in a state where variation in the suction power that is provided to the nozzle 30 is suppressed, the meniscus M of each nozzle 30 rises in a state where the variation is suppressed.

In a state where the meniscus M has risen, the control section 167 controls the driving of the wiping mechanism 35, thereby moving the wiper 34 in a direction indicated by an arrow in FIG. 14 in a state where the wiper 34 is brought into contact with the nozzle formation face 26*a* (wiping). Then, the nozzle formation face 26*a* is swept by the wiper 34.

Thereafter, the control section 167 controls the movement mechanism 165 such that the maintenance pump 161 performs discharge driving, and pushes out ink in the tube 162 suctioned from the inside of the ink flow path 32 in accordance with the previous suction driving, from the inside of the tube 162, thereby discharging the ink to the ink flow path 32 (discharging). However, since the flow path valve 60 further on the upstream side than the pressure-changing position PH, to which the maintenance pump 161 is connected, in the ink flow path 32 has been closed, the discharged ink is supplied to the downstream side. Therefore, the meniscus M which has risen in accordance with the suction driving of the maintenance pump 161 lowers in position, thereby moving to the vicinity of the nozzle orifice 44.

Figure 15:
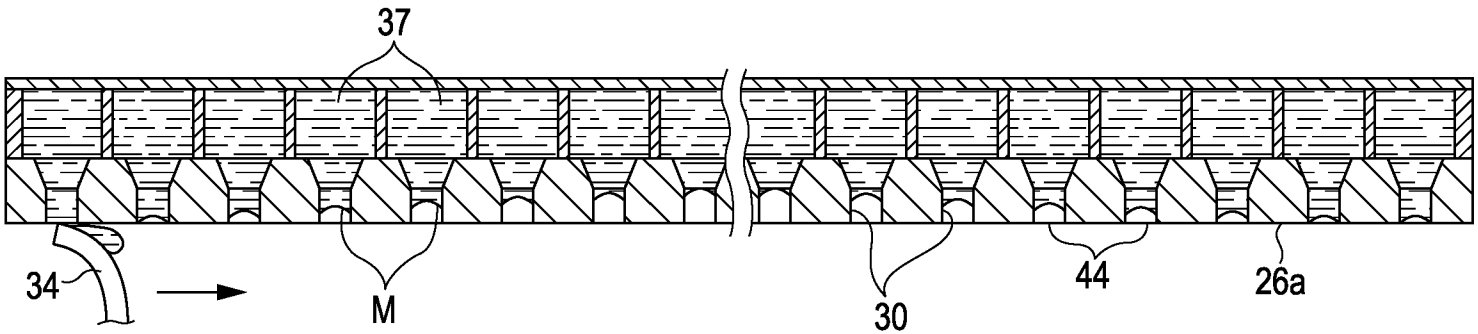
FIG. 15 is a sectional schematic diagram of a recording head of a comparative example.

FIG. 15 shows the positions of the meniscuses M in a case where an ink flow path, in which a downstream end is not branched, is connected to the central portion of the reservoir 36 and suction power is provided to one place in the reservoir 36, as a comparative example. To the nozzle 30 of the central portion close to a connection port, suction power large compared to that to the nozzles 30 of both end portions distant from the connection port is provided. For this reason, in the nozzle 30 of the central portion, the position of the meniscus M rises, whereas in the nozzles 30 of both end portions, the meniscus M does not rise, whereby variation occurs in the positions of the meniscuses M.

For this reason, if the wiper 34 moves in a state where it has come into contact with the nozzle formation face 26*a*, there is a fear that ink in the nozzle 30 may come into contact with the wiper 34, whereby the ink flows down the wiper 34 to the outside of the nozzle 30.

Further, in a case where the maintenance pump 161 performs the discharge driving, since a pressurizing force is also applied to the nozzle 30 in which the meniscus M is located in the vicinity of the nozzle orifice 44, there is a fear that ink may overflow from the nozzle 30.

Therefore, it is preferable to provide the suction power in a state where the ink flow path 32 is connected to plural positions of the reservoir 36 in such a manner that a difference of the distance between the respective nozzles 30 becomes small.

According to the above-described embodiment, the following effects can be obtained.

(5) For example, in a case where ink is suctioned by a single ink flow path 32 which is not branched, a difference in suction power which is transmitted to the respective nozzles 30 becomes large, so that variation occurs in the positions of the meniscuses M. In that respect, since the ink flow path 32 is branched and connected to the reservoir 36, it is possible to transmit suction power to plural locations in the reservoir 36. Since it is possible to sweep the nozzle formation face 26*a* by the wiper 34 in a state where the meniscuses M have risen in the respective nozzles 30, it is possible to suppress the consumption of ink accompanying the contact of the wiper 34 with ink. Since the positions of the meniscuses M move up in a state where variation in position is reduced, it is possible to suppress the overflowing of ink from the nozzle 30 at the time of the discharge driving of the maintenance pump 161. Therefore, it is possible to perform wiping where the outflow of ink from the nozzle 30 is suppressed.

(6) Since at least one connection port 36*a* is formed for each of a plurality of areas in the reservoir 36, a possibility that the downstream ends 32*b* of the ink flow path 32 may be disproportionately connected to the reservoir 36 is reduced. Therefore, the bias of suction power which is exerted to the inside of the reservoir 36 when the maintenance pump 161 performs the suction driving is suppressed, so that variation in the positions of the meniscuses M can be further reduced.

(7) It is possible to transmit pressure to the reservoir 36 through the branched ink flow path 32 by driving a single maintenance pump 161. Therefore, compared to a case where the maintenance pump 161 is provided at each ink flow path 32 which is further on the downstream side than the branching portion 32*a*, the number of parts is reduced, so that a reduction in size of the printer 11 can be attained.

(8) By performing the suction driving of the maintenance pump 161 in a state where the flow path valve 60 has been closed, it is possible to suppress the inflow of ink from the upstream side and suction ink from the downstream side. Therefore, the amount of ink which is supplied to the downstream side when the maintenance pump 161 performs the discharge driving becomes approximately equal to the amount of ink suctioned in accordance with the suction driving. For this reason, it is possible to reduce a possibility that ink may overflow from the nozzle 30, and also to reduce a possibility that the nozzle formation face 26*a* after wiping may be contaminated with ink overflowed from the nozzle 30.

In addition, the above-described embodiment may be modified as follows.

In the above-described embodiment, the maintenance pump 161 may be a piston pump or a diaphragm pump which changes the volume of a pump chamber by the displacement of a diaphragm. The maintenance pump may be constituted to be a gear pump or a vane pump, which has an ink containing chamber, and move ink from the ink flow path 32 to the ink containing chamber in the case of performing the suction driving and ink from the ink containing chamber to the ink flow path 32 in the case of performing the discharge driving. In a case where the gear pump or the vane pump is adopted as the maintenance pump 161, it is also acceptable to adopt a configuration in which the one-way valve 51 and the flow path valve 60 are not provided and ink is suctioned from the nozzle 30 side by supplying ink from the downstream side to the upstream side.

In the above-described embodiment, the flow path valve 60 may be provided at a position which is further on the upstream side than the pressure-adjusting position PT where the one-way valve 51 is provided, in the ink flow path 32. By performing the suction driving of the maintenance pump 161 in a state where the flow path valve 60 which is located further at the upstream side than the one-way valve 51 has been closed, ink further from the upstream side than the flow path valve 60 is not supplied even if the one-way valve 51 is opened, and ink is suctioned from the nozzle 30 side. On the other hand, in a case where the maintenance pump 161 performs the discharge driving, since the one-way valve 51 is closed, ink is supplied to the nozzle 30 side. Therefore, since ink suctioned from the nozzle 30 side can be supplied to the nozzle 30 side, it is possible to suppress the discharging of ink from the nozzle 30.

In the above-described embodiment, a plurality of maintenance pumps 161 and flow path valves 60 may be respectively provided at each ink flow path 32 further on the downstream side than the branching portion 32*a*. The respective branched ink flow paths 32 communicate with each other. For this reason, it is also acceptable to provide the maintenance pump 61 at a single ink flow path 32 which is branched at the branching portion 32*a* and is further on the downstream side than the branching portion 32*a*, and also provide the flow path valve 60 at the ink flow path 32 further on the upstream side than the branching portion 32*a*.

In the above-described embodiment, it is preferable if at least two connection ports 36*a* are formed in the reservoir 36 and the branched ink flow path 32 is connected to the connection ports 36*a*. Even in a case where a plurality of connection ports 36*a* is closely formed, it is possible to suppress the bias of suction power which is transmitted to the nozzles 30, compared to a case where ink is suctioned from a single connection port 36*a*.

In the above-described embodiments, the liquid ejecting apparatus is embodied in the ink jet type printer 11. However, a liquid ejecting apparatus that ejects or discharges liquid other than ink may be adopted. The invention can be applied to various liquid ejecting apparatuses that are each provided with a liquid ejecting head or the like that discharge a minutely small amount of liquid droplet. In addition, the liquid droplet describes a liquid in a state of being discharged from the liquid ejecting apparatus and also includes droplets of a granular shape or a tear shape, or droplets tailing into a line. It is acceptable if the liquid as mentioned herein is a material that can be ejected by a liquid ejecting apparatus. For example, it is acceptable if the liquid is a substance in a liquid state, and the liquid includes not only liquids in a liquid state with high or low viscosity, a flow state such as sol, gel water, other inorganic or organic solvents, solution, liquid resin, or liquid metal (metal melt), and one state of substance, but also a material in which particles of a functional material composed of a solid material such as pigment or metal particles are dissolved, dispersed, or mixed in a solvent, or the like. Also, ink as described in the above-described embodiments, a liquid crystal, or the like can be given as representative examples of the liquid. Here, ink is set to include general water-based ink and oil-based ink and various liquid compositions such as gel ink, hot-melt ink, and the like. As specific examples of the liquid ejecting apparatus, the following can be given: a liquid ejecting apparatus that ejects liquids that include, in a dispersed or dissolved form, materials such as an electrode material or a color material, which is used for the manufacturing or the like of, for example, a liquid crystal display, an EL (electroluminescence) display, a surface-emitting display, or a color filter; a liquid ejecting apparatus that ejects a biological organic matter that is used for the manufacturing of biochips; a liquid ejecting apparatus that is used as a precision pipette and ejects liquid that is a sample; a textile printing apparatus; a micro-dispenser; and the like. Further, the following liquid ejecting apparatuses may be adopted: a liquid ejecting apparatus that ejects lubricant oil to a precision machine such as a clock or a camera by using a pinpoint; a liquid ejecting apparatus that ejects a transparent resin solution such as ultraviolet curing resin onto a substrate in order to form a minute hemispherical lens (an optical lens) or the like which is used in an optical communication element or the like; and a liquid ejecting apparatus that ejects an etching solution such as acid or alkali in order to etch a substrate or the like. The invention can be applied to any one type of liquid ejecting apparatus among these.

The entire disclosure of Japanese Patent Application Nos. 2010-025281, filed Feb. 8, 2010, 2010-025280, filed Feb. 8, 2010 are expressly incorporated by reference herein.

What is claimed is:

1. A liquid ejecting apparatus comprising:

nozzles which eject liquid;

a liquid supply flow path which supplies the liquid from a liquid supply source to the nozzles;

a pump which is connected to a separate path branched from a first position in the liquid supply path, wherein the pump suctions the liquid from the first position in the liquid supply flow path and discharges the liquid from the first position into the liquid supply flow path;

a one-way valve which is provided at a second position which is further on the upstream side than the first position in the liquid supply flow path, and opened in a case where a pressure chamber, in which a volume changes in accordance with a change in pressure on the downstream side, contracts in accordance with decompression on the downstream side, thereby allowing passage of the liquid from the liquid supply source side to the nozzle side; and a control unit which controls the driving of the pump so as to make the pump suction the liquid in the liquid supply flow path from the first position after making the pump discharge the liquid from the first position into the liquid supply flow path.

2. The liquid ejecting apparatus according to claim 1, wherein the pump includes:

a volume-variable liquid chamber which communicates with the inside of the liquid supply flow path, a volume-variable gas chamber which contains gas, and a volume changing section which changes the volumes of the liquid chamber and the gas chamber, and the control unit controls the volume changing section to make the pressure of the gas compressed by reducing the volume of the gas chamber act on the liquid in the liquid chamber, thereby making the pump perform discharge driving.

3. The liquid ejecting apparatus according to claim 1, wherein an amount of liquid that the pump can suction in accordance with suction driving is larger than an amount of change in the volume of the pressure chamber.

4. The liquid ejecting apparatus according to claim 1, wherein the pump suctions the liquid out of the liquid supply flow path into the separate path, and discharges the liquid from the separate path into the liquid supply flow path.

5. The liquid ejecting apparatus according to claim 4, wherein the liquid supply flow path and the separate path define a T intersection at the first position.

6. A cleaning method in a liquid ejecting apparatus which includes nozzles which eject liquid, a liquid supply flow path which supplies the liquid from a liquid supply source to the nozzles, and a pump which is connected to a separate path branched from the liquid supply flow path, the method comprising:

suctioning the liquid in the liquid supply flow path from a first position in the liquid supply flow path; and discharging the liquid suctioned in the suctioning from the first position in the liquid supply flow path into the liquid supply flow path.

7. The cleaning method in a liquid ejecting apparatus according to claim 6, further comprising:

opening a one-way valve, after the suctioning, which is provided at a second position further on the upstream side than the first position in the liquid supply flow path and is opened in a case where a pressure chamber, in which a volume changes in accordance with a change in pressure on the downstream side, contracts in accordance with decompression on the downstream side, thereby allowing passage of the liquid from the liquid supply source side to the nozzle side.

8. The cleaning method in a liquid ejecting apparatus according to claim 7, further comprising:

closing the one-way valve after the liquid is discharged into the liquid supply flow path in the discharging.

9. The cleaning method in a liquid ejecting apparatus according to claim 6, further comprising:

suctioning the liquid in the liquid supply flow path from the first position in the liquid supply flow path after the liquid is discharged into the liquid supply flow path in the discharging.

10. The cleaning method in a liquid ejecting apparatus according to claim 6, wherein suctioning the liquid from the first position comprises suctioning the liquid out of the liquid supply flow path into the separate path, and wherein discharging the liquid into the liquid supply flow path comprises discharging the liquid from the separate path into the liquid supply flow path.

11. The cleaning method in a liquid ejecting apparatus according to claim 10, wherein the liquid supply flow path and the separate path define a T intersection at the first position.

12. A liquid ejecting apparatus comprising:

a plurality of nozzles which ejects liquid;

a liquid supply chamber which communicates with each of the plurality of nozzles, thereby supplying the liquid to each of the nozzles;

a liquid supply flow path which supplies the liquid from a liquid supply source to the liquid supply chamber and is connected at a plurality of branched flow paths thereof to the liquid supply chamber;

a pump which is connected to a separate path branched from the liquid supply flow path, wherein the pump suctions the liquid in the liquid supply flow path and discharges the liquid into the liquid supply flow path;

a wiping section which brings a wiper into contact with a nozzle formation face of a liquid ejecting head, in which the nozzles are formed, thereby sweeping the nozzle formation face; and a control unit which makes the wiping section sweep the nozzle formation face after the liquid is suctioned from the liquid supply flow path by making the pump perforin suction driving, and thereafter, makes the pump perform discharge driving, thereby discharging the liquid to the liquid supply flow path.

13. The liquid ejecting apparatus according to claim 12, wherein in the liquid supply chamber, at least one connection port, to which an end portion of the branched flow path of the liquid supply flow path is connected, is formed for each of a plurality of areas sectioned along a longitudinal direction of the liquid supply chamber.

14. The liquid ejecting apparatus according to claim 12, wherein in the liquid supply flow path, a connection position where the pump is connected is further on the upstream side than a branching portion where the liquid supply flow path is branched.

15. The liquid ejecting apparatus according to claim 12, further comprising:

a flow path valve which is provided at a position which is further on the upstream side than a connection position of the pump in the liquid supply flow path, so as to be able to open and close the inside of the liquid supply flow path, wherein the control unit carries out suction driving of the pump in a state where the flow path valve has been closed.

16. The liquid ejecting apparatus according to claim 12, wherein the pump suctions the liquid out of the liquid supply flow path into the separate path, and discharges the liquid from the separate path into the liquid supply flow path.

17. The liquid ejecting apparatus according to claim 16, wherein the liquid supply flow path and the separate path define a T intersection at the first position.

* * * * *